US005360335A

United States Patent [19]

Anderson et al.

[11] Patent Number: 5,360,335

[45] Date of Patent: Nov. 1, 1994

[54] FUEL BURNER CONTROL SYSTEM WITH SELECTABLE STANDING PILOT MODE

[75] Inventors: Gregory W. Anderson, Plymouth, Minn.; Christopher B. Fink, Willow Grove, Pa.; Bruce L. Mickelson, Cambridge, Minn.

[73] Assignee: Honeywell Inc., Minneapolis, Minn.

[21] Appl. No.: 965,126

[22] Filed: Oct. 22, 1992

[51] Int. Cl.[5] ..... F23N 5/20

[52] U.S. Cl. ..... 431/6; 431/72; 431/29; 431/31

[58] Field of Search ..... 431/72, 6, 29, 30, 31, 431/2, 18, 78

[56] References Cited

U.S. PATENT DOCUMENTS 3,814,569 6/1974 Jacobsz ..... 431/29
4,035,135 7/1977 Jacobsz .
4,249,884 2/1981 Cade .
4,901,917 2/1990 Littell, III .
4,999,792 3/1991 Anderson et al. .
5,078,317 1/1992 Kenner et al. ..... 431/29 X
5,121,880 6/1992 Adams et al. .

*Primary Examiner*—Carl D. Price
*Attorney, Agent, or Firm*—Edward L. Schwarz

[57] ABSTRACT

A burner control system with an interrupted or intermittent type of pilot burner has a special feature allowing transitions between a pilot flame hold state where the pilot flame only burns and the run state where the main burner is operating. Each transition to the pilot flame hold state from the run state comprises a brief period in which presence of the pilot flame is assured while the main flame is extinguished. Transitions to the run state from the pilot flame hold state may proceed directly through the main flame establishment period to the run state, thereby eliminating the time-consuming purging and pilot flame ignition phases.

12 Claims, 3 Drawing Sheets

LEGEND
PV- Pilot Valve
IGN- Ignition
PVH- Pilot Valve Hold
PFEP- Pilot Flame Establishing Period
MFEP- Main Flame Establishing Period
MV- Main Valve
R. fan- Recirculating Fan
C. fan- Combustion Fan

*To Fig. 2B*

LEGEND
PV- Pilot Valve
IGN- Ignition
PVH- Pilot Valve Hold
PFEP- Pilot Flame Establishing Period
MFEP- Main Flame Establishing Period
MV- Main Valve
R. fan- Recirculating Fan
C. fan- Combustion Fan

| | |
|---|---|
| *Fig. 2A* | *Fig. 2B* |

To Fig. 2A

FUEL BURNER CONTROL SYSTEM WITH SELECTABLE STANDING PILOT MODE

BACKGROUND OF THE INVENTION

Fuel burners are used in a variety of applications requiring heat energy for operation. These burner installations range from very simple and small gas dryer and water heater systems, to very large and complex systems operating with a variety of fuels in industrial uses such as in chemical plants or in commercial applications such as heating plants for large buildings or groups of buildings. It is well known of course that burner installations of any size must be carefully managed in order to achieve safe and efficient operation. Where the installation is very small, the control systems have few functions and typically have a simple sequence to bring the system from its standby state where it is waiting for a demand for heat, to its run state where fuel may flow to the combustion chamber at its maximum rate.

In the following description, the term "burner unit" will denote a combustion chamber, a main fuel valve and a pilot fuel valve feeding respectively a main and a pilot burner in the combustion chamber, a pilot fuel igniter, and a blower for providing combustion air to the combustion chamber. Certain types of units will also include a modulating main valve and a damper for regulating flow of combustion air to the combustion chamber which together allow control of the firing rate, or the rate at which fuel is consumed. The valves, igniter, and blower enter their operating states where they provide their respective functions responsive to control signals provided to each by a controller.

The operation of a burner unit is considered to comprise a number of distinct phases of operation. The typical operating sequence provided by the controller for a burner unit as it progresses from its standby mode to its run mode, is first a timed purge period, where the blower signal causes the blower to operate to remove any left-over combustion products from the combustion chamber, followed by a pilot flame ignition period during which the pilot valve signal opens the pilot valve and the igniter signal causes the igniter to operate. After the pilot flame ignition (also referred to as the pilot flame establishment period or PFEP) has been successfully completed then the main valve signal opens the main valve, and the burner unit begins main flame ignition (main flame establishment period or MFEP). The pilot flame ignites the fuel flowing from the main burner, and the burner unit then starts its run mode. The burner unit remains in the run mode until the demand has been satisfied, at which time the controller causes the main valve to close and possibly, the blower to operate for a continued purge period, after which the burner unit returns to its standby mode. In one embodiment, both the PFEP and the MFEP are 10 sec. long.

For certain types of applications, it is very desirable that burner units enter their run mode relatively quickly after it is determined that heat is required. The problem with the operating sequence described above is that for certain types of installations, the purge period is relatively lengthy, perhaps as long as 10 min. or more. Accordingly, the time period between the start of the demand signal and actual start of the run mode may be longer than is desired. On the other hand, it is important that the length of the purge and ignition periods not be shortened in order to assure the removal of any residual fuel leakage and left-over combustion fumes and in order to assure that pilot ignition is successful.

There are certain variations on this starting sequence which have been developed in other burner unit operating contexts. For example, U.S. Pat. No. 4,999,792, which has a common assignee with this application, teaches the use of an intermediate pilot flame stage during the transition from one type of fuel to another in a burner system in which multiple fuels may be used.

BRIEF DESCRIPTION OF THE INVENTION

We have developed an extension of the intermediate pilot stage used in the '792 patent in order to allow rapid transitions to and from the run mode. In this implementation, a special pilot valve hold mode is entered when the run mode is not desired. In the pilot valve hold (PVH) mode, the pilot flame is allowed to burn for an indeterminate time interval. The transitions between the run and PVH modes are delayed only by the time required to establish the new flame regime. The PVH mode is invoked by a PVH signal which is supplied to the controller from an external source, typically the burner unit operator.

The controller which has overall responsibility for operation of the burner unit provides two paths for entering the PVH mode. In the first, if the PVH signal is present at the end of the PFEP, then even if the demand signal is present, the controller does not progress into the MFEP, but rather implements the invention by continuing to providing the pilot valve signal without providing the main valve signal, in this way selecting the PVH mode responsive to coincidence of the end of the pilot ignition state and the pilot valve hold signal. When the PVH signal ends, then the controller causes the burner unit to enter the MFEP by issuing a main valve signal to open the main valve.

The second path to the PVH mode arises when the PVH signal begins during the run mode. When this occurs, then if the pilot valve signal is not presently provided by the controller, it is provided. After a predetermined interval after the start of the pilot valve signal during the run mode, the controller ends the main valve signal and substantially simultaneously, provides the ignition signal. After presence of the pilot flame is certain, then the ignition signal can be ended, and the PVH mode begins. The exit from the PVH mode is to the MFEP as occurs after the first path to the PVH mode.

BRIEF DESCRIPTION OF THE DRAWINGS

The block diagram of the burner unit and burner controller shown in FIG. 1 incorporates the features of the invention in the controller.

DESCRIPTION OF THE PREFERRED EMBODIMENT

Figure 1:
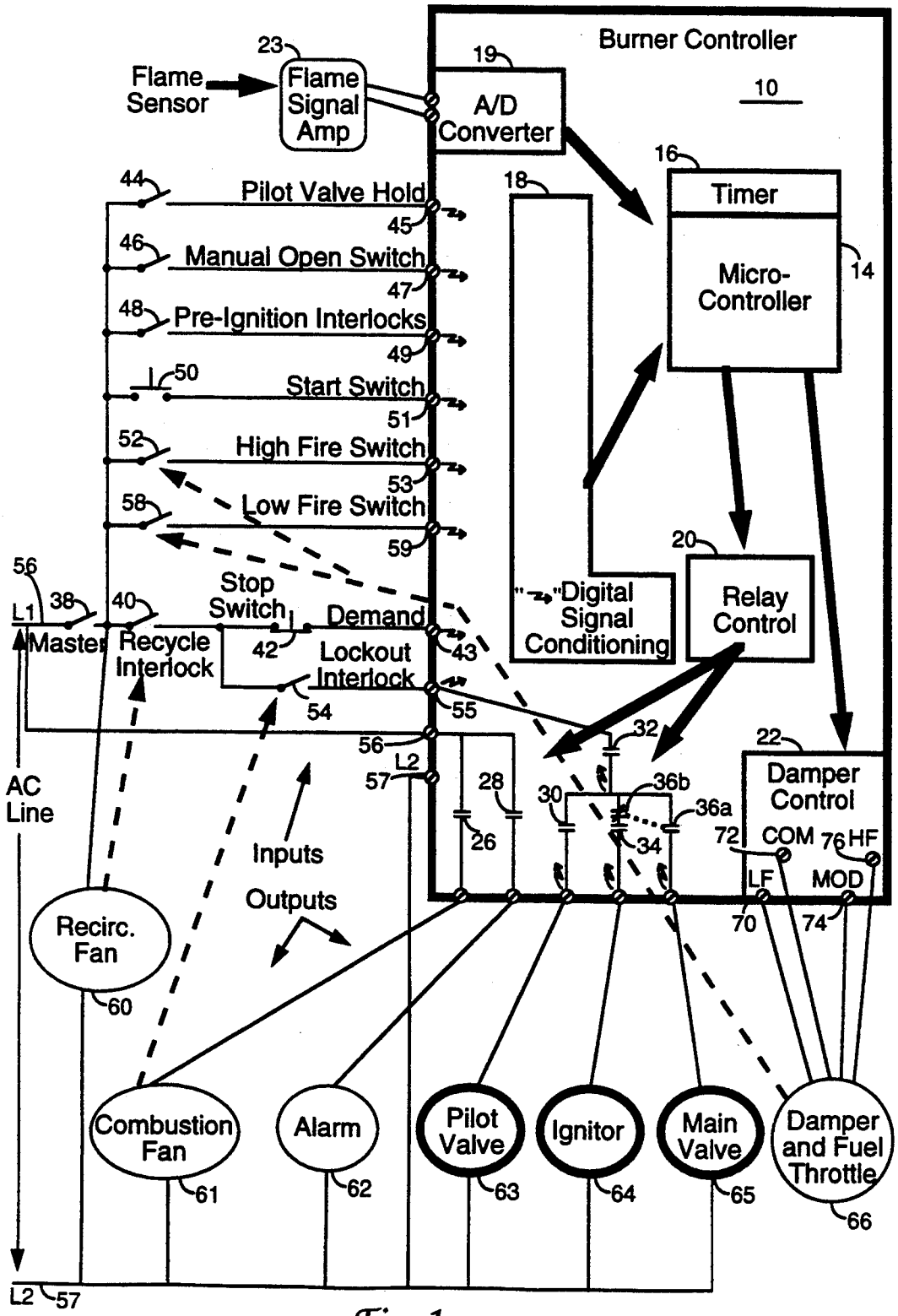

This invention is implemented in the burner unit of FIG. 1 by controller 10, which sequences the various steps involved in burner operation. As explained in the BACKGROUND section above, the operation of the burner unit of FIG. 1 comprises a number of distinct phases of operation. These begin and end with a standby mode where master switch 38 is open and all of the burner unit operating elements unpowered. The controller 10 receives power at all times as shown from the line terminals (L1 and L2) 56 and 57. (A line switch, not shown, may be included to remove all power from the burner installation including controller 10.) This power is supplied to microcontroller 14 as will as to the other control elements in controller 10.

In standby mode, controller 10 is ready to initiate a sequence of operations which move the burner unit through these operation phases from standby mode eventually to the run mode where the main flame is providing the desired heat, and then back to the standby mode. These intermediate phases between standby and run modes may take several minutes to complete. The various intermediate phases typically have durations prescribed by various safety codes, and therefore the length of the startup sequence is not easily shortened.

The burner unit itself includes a combustion chamber and flue which are not shown, in addition to the other individual elements which are shown and are directly involved in igniting and controlling flow of fuel. These elements include, more or less in the order of actuation during a normal startup, a recirculating fan 60 and a combustion fan 61 to provide air to the combustion chamber. After the recirculating fan 60 has run for a period of time to purge the combustion chamber, the combustion fan 61 and the ignitor 64 are activated and the pilot valve 63 is opened to start the pilot flame ignition period. A flame sensor provides a signal which is interpreted by a flame signal element 56 to provide a conditioned flame signal. Once a flame signal proving the existence of the pilot flame has been provided, the main valve 65 can be opened so that a main flame ignition period can start. After the main flame ignition period ends, the burner unit segues into run mode, which has an indeterminate length. In the run mode, the burner unit with which this invention is intended to be used has a throttle and damper adjustment 66 for controlling the amount of heat provided by the burner unit.

Because of the nature of the function performed by the burner unit, constant monitoring of its operation is necessary, a function for which microcontroller 14 is ideally suited. Improper operation results in lockouts or alarms, depending on the type of error, and a number of such alarms are signaled by alarm element 62.

Power to each of the individual elements of the burner unit is switched by a dedicated relay which is indirectly controlled through the relay control element 20 by microcontroller 14. Signal paths are generally indicated within controller 10 by heavy arrows emanating from the signal source and directed toward the destination. Thus, microcontroller 14 provides control signals to relay control element 20, which then provides the actuating power to the individual relay coils as symbolized by the heavy arrows directed from relay control element 20 toward the individual relay contacts. The relay contacts control the burner unit elements as shown in this table:

| Burner Unit Element | Reference Number |
|---|---|
| Combustion fan | 26 |
| Alarm | 28 |
| Pilot valve | 30 |
| Igniter | 34 and 36b |
| Main valve | 36a |

A master switch 38 provides the power for these burner unit elements. Burner unit element power is controlled by safety relay contacts 32 which are also operated by relay control element 20. Relay contacts **36*a* and 36*b* are shown as ganged together by the dotted line between them. This ganging symbol connotes the requirement that ignitor 64 be never activated when the main valve 65 is open. Thus, when the relay coil controlling contacts 36*a* and 36*b* has closed contacts 36*a* then contacts 36*b*** are open, and vice versa.

The connections between controller 10 and the various elements of the burner unit are through screw terminals which are symbolized in FIG. 1 around the periphery of the controller enclosure. Thus, screw terminals are shown as the attachment points for the various functional elements of the burner unit, as well as for the various signal input sources.

The damper and fuel throttle 66 shown as a single unit in FIG. 1 control the firing rate, or fuel flow rate to the combustion chamber. The fuel throttle regulates fuel flow to the combustion chamber, and the damper, which is in the combustion air duct, regulates the flow rate of combustion air to the combustion chamber. To maintain the proper stoichiometric ratio for most efficient combustion, it is necessary to simultaneously modulate the position of the control elements in the damper and the fuel throttle, and therefore, these two elements can logically be shown as a single unit. The damper and throttle positions are controlled by a damper control module 22 in response to commands received from microcontroller 14. In FIG. 1, low and high fire (LF and HF) throttle position power voltages are provided on terminals 70 and 76 respectively, to which the damper and fuel throttle 66 respond by shifting to the appropriate firing levels. The firing rate can be modulated by providing a power voltage of proper level at the MOD terminal 74. The common (COM) terminal 72 completes the circuits for the three different operating voltage paths.

The alarm unit 62 is powered when improper operation of the burner unit is detected, and when powered alerts the operator to the improper operation. Because the alarm unit is external to controller 10 and is connected to controller 10 by a screw terminal similar to that connecting the other burner unit elements, it is shown as a separate element forming a part of the burner unit.

Recirculating fan 60 is directly controlled by the master switch 38. Fan 60 runs constantly when the burner unit is not in standby mode. Because operation of fan 60 is critical to safety, a recirculating fan recycle interlock switch 40 is closed by proper operation of fan 60 as symbolized by the dotted line between fan 60 and interlock switch 40. Power for operating the burner functions is controlled by interlock switch 40. The combustion fan 61 also provides a critical function, and so it similarly controls a combustion fan interlock switch 54 through which burner function power passes. Thus, until both fans 60 and 61 are operating, it is not possible to leave the purge phase of the burner unit operating sequence.

Controller 10 includes a microcontroller 14 as the device which maintains overall control of the system. Microcontroller 14 includes a timer 16 which provides the needed timing functions for operation of the system. Because the I/O ports of microcontroller are unable to directly communicate with the various input signals from the various burner unit sensors, a signal conditioning element 18 receives these signals and interprets and converts them to digital levels acceptable to the microcontroller. The zigzag arrows emanating from the various screw terminals symbolize a direct connection to the conditioning element 18. Because the signals generally take the form of presence or absence of 120 VAC, the conditioning is necessary to convert the signals to the low voltage DC for which the microcontroller input ports are designed. An important conventional feature of this burner unit is a flame sensor which monitors the presence of flame in the combustion chamber. A flame signal amplifier 23 receives the output of the flame sensor and provides its amplified output to an A/D converter 19, whose digital output can be accepted directly by microcontroller 14. The microcontroller 14 constantly monitors the signal from A/D converter 19, and if flame is indicated by this signal when not expected, or is not indicated when expected, at any point in the operating sequence, the main and pilot valves 63 and 65 are immediately closed and alarm relay contacts 28 are closed to activate the alarm. In addition, the system is locked out until manual intervention by an operator.

Each of the burner unit elements 63, 64, 65 have a zigzag arrow denoting a signal input to conditioning element 18 which indicates current power status for that element. There are also a number of control and operating status signals which are provided to conditioning element 18. These can be seen along the left hand side of controller 10. A number of these switches close when a burner unit element enters a particular state. This relationship is symbolized in FIG. 1 by a dotted line drawn from the element whose state controls, to the switch which controlled by the state of the element. Thus, recycle interlock switch 40 closes when recirculating fan 60 reaches a certain speed. The lockout interlock switch 54 closes when the combustion fan 61 reaches a certain speed. The low and high fire switches 52 and 58 close when the damper and fuel throttle 66 reach their low and high fire positions respectively. The following table defines the purpose of each and the reference numbers for the switch which controls the signal and the screw terminal which receives the signal.

| Signal Name | Purpose | Switch Ref. No. | Terminal Ref. No. |
|---|---|---|---|
| Pilot Valve Hold | Selects pilot valve hold mode | 44 | 45 |
| Manual Open | Selects manual opening for main valve | 46 | 47 |
| Pre-Ignition Interlocks | Senses status of pre-ignition interlock switch string | 48 | 49 |
| Start Switch | Allows manual start of operating sequence | 50 | 51 |
| High Fire Switch | Closes when damper and fuel throttle enter high fire position | 52 | 53 |
| Low Fire Switch | Closes when damper and fuel throttle enter low fire position | 58 | 59 |
| Stop Switch/ Demand | Allows manual stop of operating sequence by opening; when closed, applies demand voltage from master switch 38 to controller | 42 | 43 |
| Lockout Interlock | Indicates proper operation of combustion fan | 54 | 55 |

The mode of operation for the burner unit of FIG. 1 to which this invention is directed, is invoked by the pilot valve hold signal on terminal 45. The remainder of the signals have been included to allow the reader to better understand the context in which the invention operates.

Figure 2A:
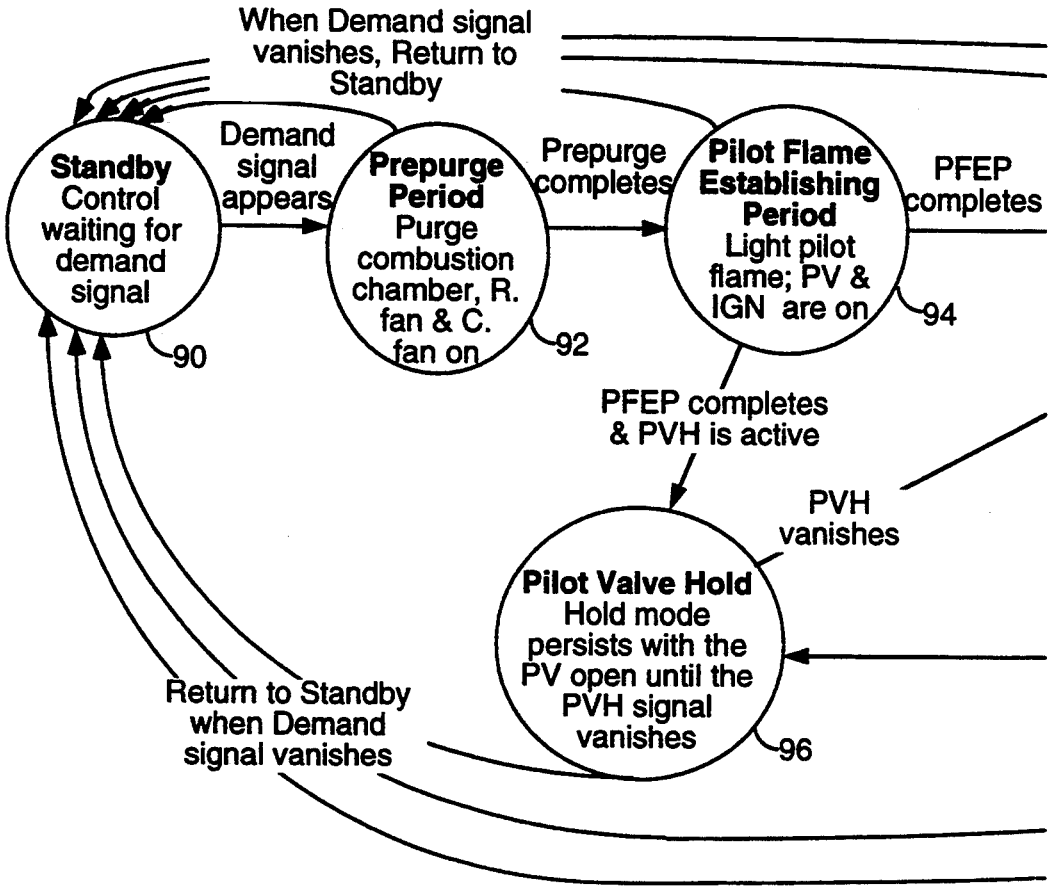
FIGS. 2A and 2B are intended to be placed together in the manner shown in FIG. 2A to constitute a state diagram defining the invention and implemented by the apparatus of FIG. 1.
Figure 2B:
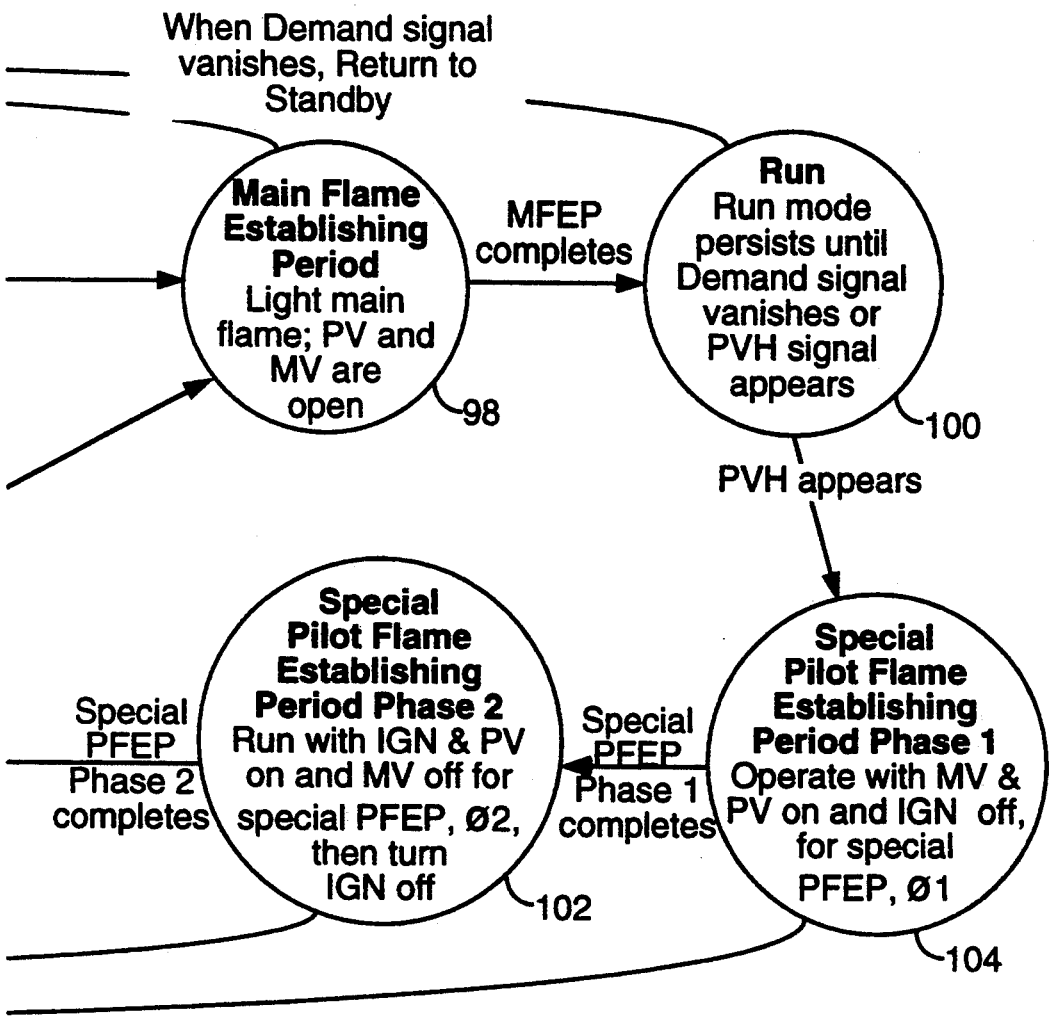

The state diagram of FIGS. 2A and 2B explains how the apparatus of FIG. 1 implements the invention. An explanation of what information is presented by a state diagram is likely to be helpful in understanding the operation of the invention. Each circular block represents a particular mode or condition of the burner unit. Each of the activity lines connecting two of the blocks is labeled with the activity or change in the burner unit which defines the progression as indicated by the arrow from the predecessor state to the successor state. The individual changes from state to state will be explained with reference to the signals and elements of FIG. 1.

It will also be helpful to explain how this state diagram defines the invention. The invention exists on two levels. The first is the method which defines the changes which the apparatus of FIG. 1 undergoes as the invention is practiced. The second is the apparatus, including the controller 10 with its microcontroller 14 which controls and cooperates with the remaining elements of the burner unit to comprise the invention. The state diagram clearly explains how the controller 10 causes the operation of the apparatus of FIG. 1 to define the invention.

In FIG. 2, block 90 represent the standby mode about which there has already been discussion. The reader will notice that there are activity lines from each of the other blocks of FIGS. 2A and 2B which terminate at block 90. This indicates that whenever the demand signal is removed by opening any of the switches between the line L1 power terminal 56 and the demand signal screw terminal 43, the burner unit returns to its standby mode.

When the demand signal appears at terminal 43, block 92 becomes the burner unit state. Block 92 represents the (pre)purge period during which the recirculating and combustion fans 60 and 61 are both run to assure that air within the combustion chamber has no contaminants in it. During the prepurge time, the controller 14 activate combustion fan 61 after the master switch 38 has been closed and the recirculating fan 60 has come up to speed sufficiently to close the recycle interlock switch 40 and apply the demand signal to terminal 43.

When the prepurge period has elapsed, the sequence progresses to block 94 which represents the PFEP in which the pilot valve 63 is opened and ignitor 64 is enabled by powering the windings which close relay contacts 30, 32 and 34, thereby lighting the pilot flame. In the design to which this invention is to be initially applied, an operator must also briefly close the start switch 50 to enable the progression to the PFEP. After the PFEP is ended, the sequence progresses to one of two states. If the PVH switch has been closed so that the PVH signal is applied to terminal 45, then the burner unit progresses to the PVH mode represented by block 96. In this state, the controller holds the pilot valve 63 open by maintaining contacts 30 and 32 closed, so that the pilot flame continues to burn. If the PVH signal is not present on terminal 45, then the burner unit state progresses to the MFEP represented by block 98.

In the MFEP, controller 14 provides a signal to damper control 22 selecting the low fire state and also provides a signal to relay control 20 causing power to be applied to the winding of relay contacts **36*a* closing them and opening main valve 65. Note that applying power to the winding for contact 36***a* causes contacts 36*b* to open and deactivate ignitor 64 so as to assure that the main flame is never lit directly from the ignitor 64. The fuel flowing through the main valve 65 is ignited by the pilot flame and after the MFEP has ended, the state of the burner unit shifts to the run mode defined by block 100. In the run mode as was explained earlier, the main valve 65 is continued to be held open and the pilot valve 63 may be closed by removing power from the winding for contacts 30. The run mode continues for so long as the demand signal on terminal 43 is present or the PVH signal on terminal 45 is not present. If the demand signal vanishes (because one of the switches which connects terminal 43 to the L1 power line 56 opens) the state changes to that of the standby mode of block 90 as indicated by the label on the activity line connecting block 100 to block 90.

If, on the other hand, the PVH signal provided at terminal 45 becomes active while the burner unit is in the run mode of block 100, then the state of the burner unit becomes phase 1 of the special PFEP in block 104. In the state of block 104, the microcontroller 14 provides a signal to the relay control element 20 causing the relay winding which controls contacts 30 to close these contacts if they have been open during the run mode of block 100. In the present installation, after a period of 45 secs. in phase 1, special PFEP, the burner unit state progresses to phase 2, special PFEP, represented by block 102. In phase 2, special PFEP, the microcontroller 14 causes relay control element 20 to remove power from the contacts 36*a* winding which opens these contacts and removes power from main valve 65, causing it to close. As contacts 36*a* open, the microcontroller 14 causes the relay control element 20 to provide power to the winding which causes contacts 34 to close and apply power to the ignitor 64. After a period which may be approximately 10 sec., the microcontroller 14 causes relay control element 20 to remove power from the winding controlling contacts 34, which disables operation of ignitor 64. This completes the actions of phase 2, special PFEP, and the state of the burner unit then becomes that specified by the PVH mode of block 96, which persists as long as the PVH signal is present.

It can thus be seen that this invention provides a method and apparatus for maintaining a burner unit in a state which can quickly enter the run mode without a lengthy series of preparation steps.

The preceding description allows one to understand and practice the invention which we claim as follows:

1. In a system for controlling operation of a burner unit comprising a combustion chamber, a main fuel valve and a pilot fuel valve respectively controlling flow of fuel to main and pilot burners in the combustion chamber, a pilot fuel igniter, and a blower for providing air to the combustion chamber, said main fuel and pilot fuel valves, pilot fuel igniter, and blower each having an operating state wherein each is performing its respective function, and a second inactive state, and entering their respective operating states responsive to main valve, pilot valve, igniter, and blower control signals respectively, said system including a burner controller receiving an external demand signal and responsive thereto providing a normal sequence of control signals allowing a transition of the burner unit from a standby mode of operation where no control signals are provided to a run mode of operation defined by the burner controller providing to each of the main fuel valve and the blower its respective control signal, said normal sequence of control signals comprising: providing a blower control signal for a predetermined interval defining a purge mode of operation; thereafter maintaining the blower control signal for at least a further predetermined interval and simultaneously providing ignition and pilot valve control signals for a controllable interval defining a pilot ignition mode of operation; thereafter and coincident with a trailing portion of the pilot ignition mode, providing pilot and main valve control signals defining a main ignition mode of operation; and thereafter ending the pilot valve control signal and continuing to provide the main valve control signal to thereby enter the run mode, an improved sequence of control signals for operating the burner unit, said improved sequence allowing transition of the burner to a pilot mode of operation from at least one preselected mode of operation responsive to the presence of an externally supplied pilot valve hold signal, said improved method comprising the steps of a) responsive to the start of the pilot valve hold signal during the run mode, providing the pilot valve control signal, and after a predetermined interval after the start of the pilot valve control signal during the run mode, ending the main valve control signal and substantially simultaneously, providing the ignition control signal; and thereafter, b) providing a main valve control signal responsive to the end of the pilot valve hold signal.

2. The method of claim 1 for use with a system having a modulating fuel flow control valve through which fuel for the main burner flows, said fuel flow control valve entering a low fire state which provides a reduced amount of fuel to the main burner responsive to a low fire control signal, wherein the method further comprises providing a low fire control signal to the fuel flow control valve responsive to each start of the pilot valve hold signal during the run state.

3. The method of claim 2 including the step of ending the pilot valve control signal responsive to end of the demand signal.

4. The method of claim 2, including the step of ending the ignition control signal a predetermined interval after the end of the main valve control signal when the pilot valve hold signal is present.

5. The method of claim 1, including the step of ending the ignition control signal a predetermined interval after the end of the main valve control signal when the pilot valve hold signal is present.

6. The method of claim 1, including the further step of providing the pilot valve control signal to thereby define the pilot mode responsive to coincidence of the end of the pilot ignition mode and the presence of the pilot valve hold signal.

7. A system for controlling operation of a burner unit comprising a combustion chamber, a main fuel valve and a pilot fuel valve respectively controlling flow of fuel to main and pilot burners in the combustion chamber, a pilot fuel igniter, and a blower for providing air to the combustion chamber, said main fuel and pilot fuel valves, pilot fuel igniter, and blower each having an operating state wherein each is performing its respective function, and a second inactive state, and each entering its operating state responsive to main valve, pilot valve, igniter, and blower control signals respectively, said system including a controller receiving an external demand signal and responsive thereto, providing a normal sequence of control signals allowing a transition of the burner unit from a standby mode of operation where no control signals are provided, to a run mode of operation, said normal sequence of control signals comprising: a blower control signal existing for a predetermined interval defining a purge mode of operation; thereafter the blower control signal for at least a further predetermined interval and simultaneously, ignition and pilot valve control signals existing for a controllable interval defining a pilot ignition mode of operation; thereafter and coincident with a trailing portion of the pilot ignition state, pilot and main valve control signals defining a main ignition mode of operation; and thereafter the end of the pilot valve control signal and the continuance of the main valve control signal to thereby form the run mode, an improvement for operating the burner unit to allow transitions to a pilot mode of operation from at least one preselected mode of the burner responsive to the presence of an externally supplied pilot valve hold signal, comprising in the controller:

a) means responsive to the start of the pilot valve hold signal during the run mode, for providing the pilot valve control signal, and after a predetermined interval after the start of the pilot valve control signal during the run mode, ending the main valve control signal and substantially simultaneously, providing the ignition control signal; and b) means receiving the pilot valve hold signal, for providing a main valve control signal responsive to the end of the pilot valve hold signal.

8. The improvement of claim 7 for use with a system having a modulating fuel flow control valve through which fuel for the main burner flows, said fuel flow control valve entering a low fire state which provides a reduced amount of fuel to the main burner responsive to a low fire control signal, wherein the improvement further comprises means in the controller receiving the pilot valve hold signal, for providing a low fire control signal to the fuel flow control valve responsive to each mode of the pilot valve hold signal during the run state.

9. The improvement of claim 8 including means in the controller for ending the pilot valve control signal responsive to end of the demand signal.

10. The improvement of claim 7 including means in the controller for ending the pilot valve control signal responsive to end of the demand signal.

11. The improvement of claim 7, including means in the controller receiving the pilot valve hold signal for ending the ignition control signal a predetermined interval after the end of the main valve control signal when the pilot valve hold signal is present.

12. The improvement of claim 7, including means in the controller receiving the pilot valve hold signal, for providing the pilot valve control signal to thereby enable the pilot mode responsive to coincidence of the end of the pilot ignition mode and the pilot valve hold signal.

* * * * *

UNITED STATES PATENT AND TRADEMARK OFFICE

CERTIFICATE OF CORRECTION

PATENT NO. : 5,360,335

DATED : Nov. 1, 1994

INVENTOR(S) : Gregory W. Anderson, Christopher B. Fink, Bruce L. Mickelson

It is certified that error appears in the above-identified patent and that said Letters Patent is hereby corrected as shown below:

Column 8, line 38, replace "state" with --mode--.

Column 10, line 13, replace "mode" with --start--;
replace "state" with --mode--.

Signed and Sealed this

Thirtieth Day of May, 1995

*Attest:*

Bruce Lehman

BRUCE LEHMAN

*Attesting Officer*

*Commissioner of Patents and Trademarks*